US008183843B2

(12) United States Patent
Einerman et al.

(10) Patent No.: US 8,183,843 B2
(45) Date of Patent: May 22, 2012

(54) VOLTAGE REGULATOR AND ASSOCIATED METHODS

(75) Inventors: Wenche Einerman, Lidingo (SE); Christer Jansson, Linkoping (SE)

(73) Assignee: Infineon Technologies AG, Neubiberg (DE)

( * ) Notice: Subject to any disclaimer, the term of this patent is extended or adjusted under 35 U.S.C. 154(b) by 555 days.

(21) Appl. No.: 11/627,659

(22) Filed: Jan. 26, 2007

(65) Prior Publication Data

US 2008/0180074 A1 Jul. 31, 2008

(51) Int. Cl.
*G05F 1/00* (2006.01)

(52) U.S. Cl. ..... 323/274; 323/280

(58) Field of Classification Search ..... 323/273–281
See application file for complete search history.

(56) References Cited

U.S. PATENT DOCUMENTS

| | | | | |
|---|---|---|---|---|
| 4,362,060 | A * | 12/1982 | Okayama et al. | 73/708 |
| 6,559,623 | B1 * | 5/2003 | Pardoen | 323/274 |
| 6,765,374 | B1 * | 7/2004 | Yang et al. | 323/280 |
| 6,861,827 | B1 * | 3/2005 | Yang et al. | 323/273 |
| 2001/0024140 | A1 | 9/2001 | Taylor | |
| 2005/0212499 | A1 * | 9/2005 | Yasukouchi | 323/282 |
| 2006/0001493 | A1 * | 1/2006 | Harms et al. | 330/308 |
| 2006/0103471 | A1 * | 5/2006 | Noda | 330/308 |
| 2007/0205824 | A1 * | 9/2007 | Perisetty | 327/536 |
| 2008/0001661 | A1 * | 1/2008 | Tachibana et al. | 330/253 |

FOREIGN PATENT DOCUMENTS

JP 2005258644 A 9/2005

OTHER PUBLICATIONS

"German Application Serial No. 102008005895.5, Office Action mailed Jun. 7, 2011", (w/English translation), 21 pgs.

* cited by examiner

*Primary Examiner* — Harry Behm
*Assistant Examiner* — Matthew Grubb
(74) *Attorney, Agent, or Firm* — Schwegman, Lundberg, & Woessner, P.A.

(57) ABSTRACT

A regulated voltage is generated at an output terminal of a voltage regulator circuit having at least one input terminal. A feedback signal is coupled from a first transistor coupled in parallel with a first resistor between the output terminal and the input terminal. The feedback signal is coupled to the input terminal to regulate the stability of the voltage regulator circuit. In a method of operation, the stability of a circuit is regulated by generating a feedback signal in the circuit to add a zero to a transfer function and raise an open loop phase curve of the circuit to result in a better power signal rejection ratio over a frequency range for the circuit.

5 Claims, 6 Drawing Sheets

200
VDD
VDD_REG
V_GND
V_REF
250
202
204
206
217
215
218
230
234
235
236
240
242
244
246
260
220
224
219
214
211
222

VOLTAGE REGULATOR AND ASSOCIATED METHODS

TECHNICAL FIELD

The subject matter relates generally to voltage regulators and associated methods in connection with such voltage regulators.

BACKGROUND

Modern electronic devices operate with low regulated voltages to reduce power consumption. There is a need for improved voltage regulators and methods of generating regulated voltages.

DETAILED DESCRIPTION

The various embodiments described herein are merely illustrative. Therefore, the various embodiments shown should not be considered as limiting of the claims.

According to various embodiments, a p-channel transistor is described as being activated or switched on when a gate-source voltage $V_{GS}$ is less than a threshold voltage Vt, $V_{GS}<Vt$, and a drain-source voltage $V_{DS}<(V_{GS}-V_t)$. A p-channel transistor is in a triode region when $V_{GS}<Vt$ and $V_{DS}>(V_{GS}-V_t)$.

Figure 1:
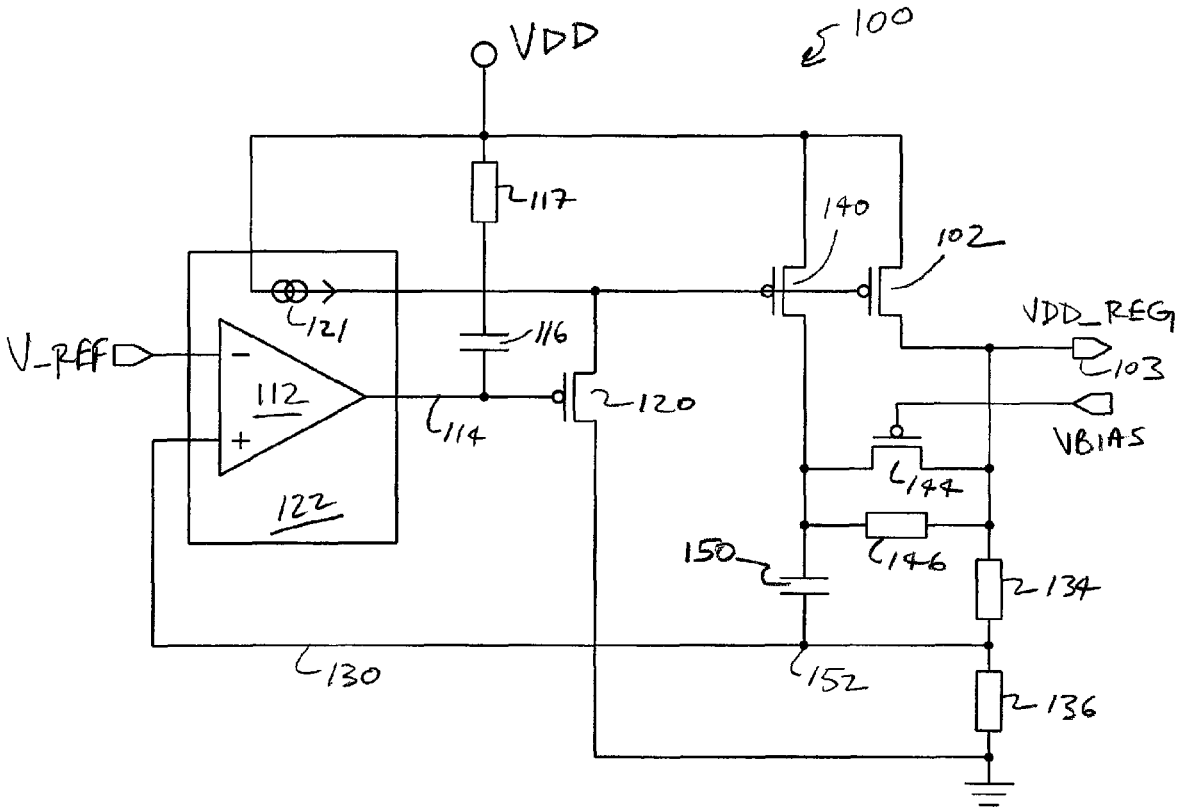
FIG. 1 illustrates an electrical schematic diagram of a voltage regulator circuit according to various embodiments.

FIG. 1 illustrates an electrical schematic diagram of a voltage regulator circuit 100 according to various embodiments. The circuit 100 includes a p-channel current driving transistor 102 having a source coupled to a supply voltage VDD and a drain coupled to an output node 103 at a regulated voltage VDD_REG. The driving transistor 102 is controlled by a signal on its gate. A DC voltage on the gate of the driving transistor 102 is less than the supply voltage VDD on the source of the driving transistor 102 to switch on the driving transistor 102.

An operational amplifier 112 in the circuit 100 has an inverting input coupled to a reference voltage V_REF and a non-inverting input coupled to a feedback signal. The operational amplifier 112 generates a control signal on a line 114 based on its inputs.

The control signal is coupled through a capacitor 116 and a resistor 117 to the supply voltage VDD. The capacitor 116 sets a pole and the resistor 117 in combination with the capacitor 116 sets a zero for the circuit 100.

A p-channel source-follower transistor 120 has a gate coupled to the output of the operational amplifier 112 to receive the control signal, and has a source coupled to the gate of the driving transistor 102. The source-follower transistor 120 regulates the signal on the gate of the transistor 102 by being more or less conductive in response to the control signal. A drain of the source-follower transistor 120 is coupled to a ground voltage reference. A current source 121 couples a current signal to the source of the source-follower transistor 120. The current source 121 and the operational amplifier 112 are located in a control circuit 122.

The non-inverting input of the operational amplifier 112 is coupled to a line 130 to receive a feedback signal from a DC feedback loop and an AC feedback loop. The DC feedback loop includes a resistor 134 and a resistor 136, coupled together in series between the drain of the transistor 102 at the regulated voltage VDD_REG and the ground voltage reference. The resistors 134 and 136 are a voltage divider to divide the regulated voltage VDD_REG to generate a divided voltage that is coupled to the line 130 and the non-inverting input of the operational amplifier 112.

The circuit 100 generates the regulated voltage VDD_REG in the following manner. The operational amplifier 112 strives to have the same signal on the inverting and non-inverting inputs, and to have the feedback signal on the line 130 be equal to the reference voltage V_REF. Thus, if the regulated voltage VDD_REG rises, the feedback signal on the non-inverting input of the operational amplifier 112 will rise and the control signal on the output of the operational amplifier 112 will then increase. The increased control signal results in the source-follower transistor 120 being less conductive, and the voltage on the gate of the driving transistor 102 increases to make the driving transistor 102 less conductive, and the regulated voltage VDD_REG will decrease. The circuit 100 has the opposite response for a fall in VDD_REG. If the regulated voltage VDD_REG falls, the feedback signal on the non-inverting input of the operational amplifier 112 will fall and the control signal on the output of the operational amplifier 112 will then decrease. The decreased control signal results in the source-follower transistor 120 being more conductive, and the voltage on the gate of the driving transistor 102 decreases to make the driving transistor 102 more conductive, and the regulated voltage VDD_REG will increase.

The AC feedback loop includes two p-channel transistors 140 and 144, a resistor 146, and a capacitor 150. The transistor 140 has a source coupled to the supply voltage VDD and a gate coupled to the source of the transistor 120 to receive the same signal as the gate of the transistor 102. The transistor 140 has a drain coupled to a capacitor 150. The transistor 144 is a p-channel transistor and has a gate coupled to a bias voltage V_BIAS to switch the transistor 144 on, a source coupled to the drain of the transistor 102 at the regulated voltage VDD_REG, and a drain coupled to the drain of the transistor 140 and the capacitor 150.

The resistor 146 is coupled between the drain and the source of the transistor 144. The transistor 144 and the resistor 146 coupled in parallel generate an AC feedback signal from the regulated voltage VDD_REG that is coupled through the capacitor 150 to a node 152 on the line 130. The AC feedback signal adds a zero to a transfer loop or transfer function of the circuit 100, which raises an open loop phase curve and gives a better power signal rejection ratio (PSR) over a frequency range for the circuit 100. The transistor 140 adjusts an open loop phase and gain bandwidth of the circuit 100.

The transistor 144 limits the resistance value of the resistor 146 when the circuit 100 is heavily loaded and the regulated voltage VDD_REG falls. The bias voltage V_BIAS follows the regulated voltage VDD_REG, such that when the regulated voltage VDD_REG rises or falls, so does the bias voltage V_BIAS on the gate of the transistor 144. When the regulated voltage VDD_REG is loaded, V_BIAS will fall and the transistor 144 will be more conductive with respect to the resistor 146. The transistor 144 operates in a linear region.

Figure 2:
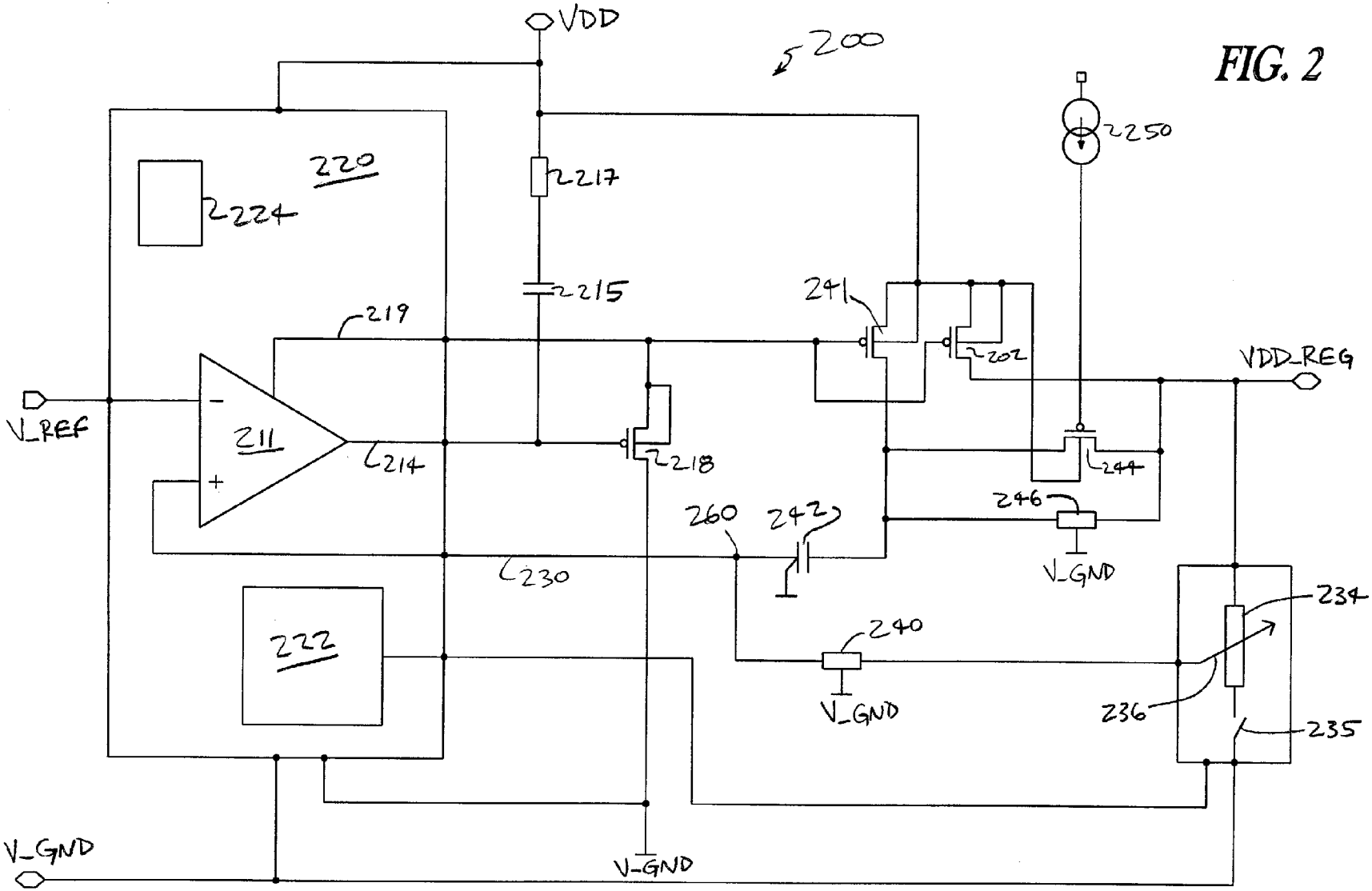
FIG. 2 illustrates an electrical schematic diagram of a voltage regulator circuit according to various embodiments.

FIG. 2 illustrates an electrical schematic diagram of a voltage regulator circuit 200 according to various embodiments. A p-channel current driving transistor 202 has a source coupled to a supply voltage VDD and a drain at a regulated voltage VDD_REG. A gate of the transistor 202 is coupled to receive a signal to control the regulated voltage VDD_REG.

An operational amplifier 211 in the circuit 200 generates a control signal on an output line 214 that is coupled through a capacitor 215 and a resistor 217 to the supply voltage VDD. The capacitor 215 sets a pole and the resistor 217 in combination with the capacitor 215 sets a zero for the circuit 200.

The control signal on the line 214 is also coupled to gate of a p-channel source-follower transistor 218 having a source coupled to the gate of the transistor 202. A drain of the transistor 218 is coupled to a ground voltage reference V_GND. A current signal from the operational amplifier 211 is coupled on a line 219 to the source of the source-follower transistor 218. The source-follower transistor 218 regulates the voltage on the gate of transistor 202 by being more or less conductive based on the control signal from the operational amplifier 211.

The ground voltage reference V_GND is coupled to a control circuit 220 that includes the operational amplifier 211. The control circuit 220 is also coupled to receive the supply voltage VDD and includes a first logic circuit 222 and a second logic circuit 224.

The operational amplifier 211 has an inverting input coupled to receive a reference voltage V_REF and a non-inverting input coupled to a line 230 to receive a feedback signal. The circuit 200 includes a DC feedback loop and an AC feedback loop to generate the feedback signal on the line 230. The operational amplifier 211 generates the control signal based on the reference voltage V_REF and the feedback signal in a manner analogous to the operation of the circuit 100 described above.

The DC feedback loop starts at the drain of the transistor 202 at the regulated voltage VDD_REG and includes a resistor 234 coupled between the drain of the transistor 202 and a switch 235 to V_GND. A slider 236 is positioned on the resistor 234 to tap a fraction of the regulated voltage VDD_REG from the resistor 234. The slider 236 and the resistor 234 together form a voltage divider to divide the regulated voltage VDD_REG into a divided voltage. The slider 236 is positioned mechanically or electrically according to various embodiments. The divided voltage tapped from the resistor 234 is coupled through a resistor 240 to the line 230 to provide a DC feedback signal to the non-inverting input of the operational amplifier 211.

The circuit 200 generates the regulated voltage VDD_REG in the following manner. The operational amplifier 211 strives to have the same signal on the inverting and non-inverting inputs, to have the feedback signal on the line 230 be equal to the reference voltage V_REF. Thus, if the regulated voltage VDD_REG rises, the feedback signal on the non-inverting input of the operational amplifier 211 will rise and the control signal on the output of the operational amplifier 211 will then increase. The increased control signal results in the source-follower transistor 218 being less conductive, and the voltage on the gate of the driving transistor 202 increases and to make the driving transistor 202 less conductive, and the regulated voltage VDD_REG will decrease. The circuit 200 has the opposite response for a fall in VDD_REG. If the regulated voltage VDD_REG falls, the feedback signal on the non-inverting input of the operational amplifier 211 will fall and the control signal on the output of the operational amplifier 211 will then decrease. The decreased control signal results in the source-follower transistor 218 being more conductive, and the voltage on the gate of the driving transistor 202 decreases to make the driving transistor 202 more conductive, and the regulated voltage VDD_REG will increase.

The AC feedback loop includes a p-channel transistor 241, a capacitor 242, a p-channel transistor 244, and a resistor 246. The p-channel transistor 241 has a gate coupled to the source of the source-follower transistor 218, a source coupled to the supply voltage VDD, and a drain. The gate of the transistor 241 receives the same signal as the gate of the transistor 202.

A current source 250 generates a potential coupled to a gate of the transistor 244 to render the transistor 244 conductive. The potential follows the regulated voltage VDD_REG, such that when the regulated voltage VDD_REG rises or falls, so does the potential on the gate of the transistor 244. The transistor 244 limits the resistance value of the resistor 246 when the circuit 200 is heavily loaded. When VDD_REG falls due to high current loads on the circuit 200, the potential on the gate of the transistor 244 falls due to the current load and the transistor 244 will be more conductive with respect to the resistor 246. The transistor 244 operates in a linear region.

The transistor 244 has a source coupled to the resistor 246 and the drain of the transistor 202 at the regulated voltage VDD_REG. The resistor 246 is coupled between the source and a drain of the transistor 244 to be in parallel with the transistor 244. A drain of the transistor 241 is coupled to the drain of the transistor 244 and the resistor 246. The drain of the transistor 244 and the resistor 246 are coupled to the capacitor 242 such that the parallel coupling of the transistor 244 and the resistor 246 generate an AC feedback signal from the regulated voltage VDD_REG that is passed through the capacitor 242 to a node 260 on the 230.

The AC feedback signal from the parallel coupling of the transistor 244 and the resistor 246 adds a zero to a transfer loop or transfer function of the circuit 200. The AC feedback signal raises an open loop phase curve and gives a better PSR over a frequency range for the circuit 200. The transistor 241 adjusts an open loop phase and gain bandwidth of the circuit 200.

Each of the transistors 202, 218, 241 and 244 in the circuit 200 have a body terminal that is coupled either to its source or to a voltage higher than the voltage on its source. The transistors 202, 218 and 241 each have a body terminal coupled to its source, and the transistor 244 has a body terminal coupled to the supply voltage VDD. The ground voltage reference V_GND is coupled to the resistors 240 and 246 and to the capacitor 242 as well as the drain of the source-follower transistor 218 and the control circuit 220.

Figure 3:
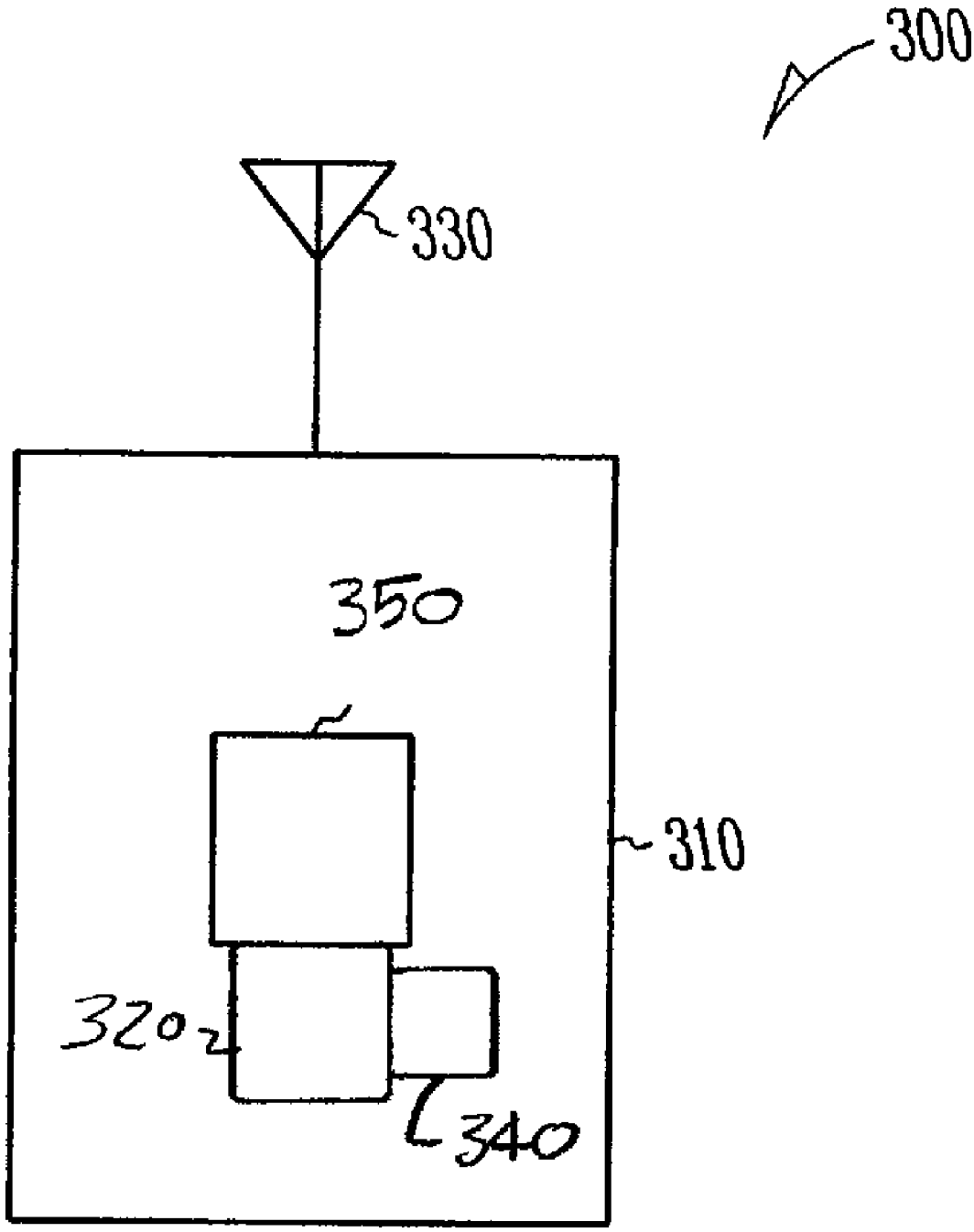
FIG. 3 illustrates an electronic device with a voltage regulator circuit according to various embodiments.

FIG. 3 illustrates an electronic device 300 with a voltage regulator circuit according to various embodiments. The device 300 includes various elements within a housing 310, including a voltage regulator circuit 320 according to various embodiments described herein. The device 300 may be hand-held or larger. The device 300 may be a music player, a computer, a camera, a voice recorder, a television set-top box, or a digital game.

The device 300 may be a mobile device with an antenna 330, and may be a laptop computer, a cellular phone, a radio, or a television. The voltage regulator circuit 320 may be coupled to receive a voltage from a battery 340. The voltage regulator circuit 320 may be coupled to provide a regulated voltage to a radiofrequency (RF) connectivity circuit 350. The RF connectivity circuit 350 may be a Digital European Cordless Telephone or Digital Enhanced Cordless Communication (DECT) semiconductor chip or application specific integrated circuit (ASIC). The RF connectivity circuit 350 may also be a Bluetooth semiconductor chip or ASIC or a wireless local area network (WLAN) semiconductor chip or ASIC. The voltage regulator circuit 320 is coupled to provide, for example, 1.5 volts or 1.8 volts to the RF connectivity circuit 350 even if the voltage from the battery 340 varies according to various embodiments. The voltage regulator circuit 320 may be loaded up to 100 milliamps according to various embodiments.

Figure 4:
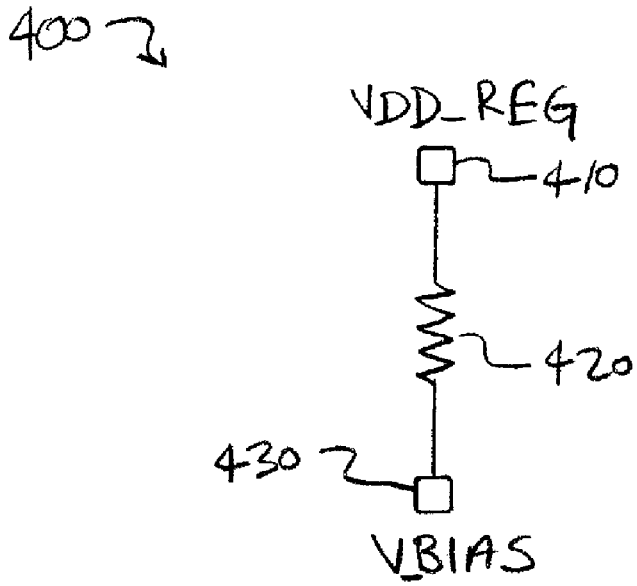
FIG. 4 illustrates an electrical schematic diagram of a circuit according to various embodiments.

FIG. 4 illustrates an electrical schematic diagram of a circuit 400 according to various embodiments. As described above with reference to FIG. 1, The bias voltage V_BIAS on the gate of the transistor 144 follows the regulated voltage VDD_REG, such that when the regulated voltage VDD_REG rises or falls, so does the bias voltage V_BIAS. The bias voltage V_BIAS may be generated by a resistive coupling with the regulated voltage VDD_REG according to various embodiments. The regulated voltage VDD_REG is coupled to a first terminal 410 of a resistor 420 in the circuit 400, and the bias voltage V_BIAS may be generated on a second terminal 430 of the resistor 420. The bias voltage V_BIAS would therefore be equal to the regulated voltage VDD_REG less a potential drop across the resistor 420.

Figure 5:
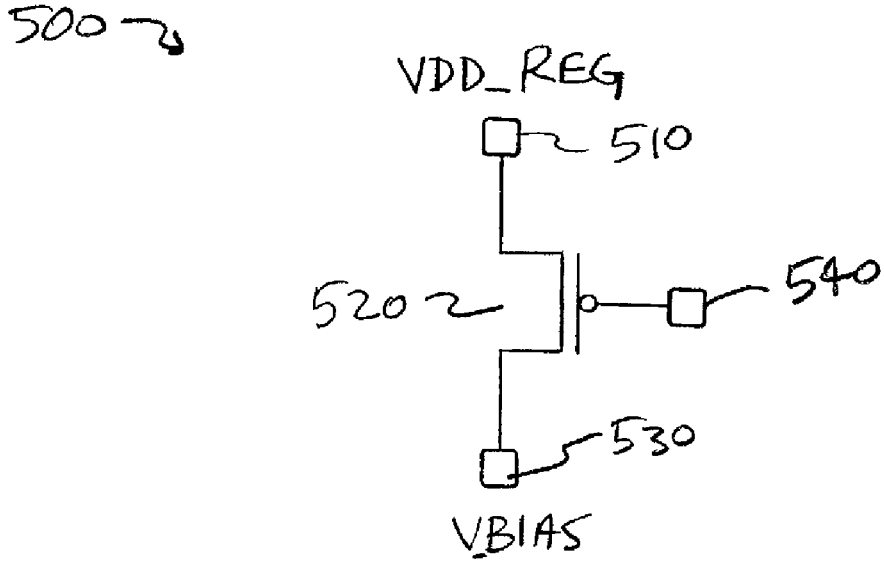
FIG. 5 illustrates an electrical schematic diagram of a circuit according to various embodiments.

FIG. 5 illustrates an electrical schematic diagram of a circuit 500 according to various embodiments. The bias voltage V_BIAS discussed above with reference to FIG. 1 may be generated by a transistor coupled to the regulated voltage VDD_REG according to various embodiments. The regulated voltage VDD_REG is coupled to a source 510 of a p-channel transistor 520 in the circuit 500, and the bias voltage V_BIAS may be generated on a drain 530 of the transistor 520. An appropriate potential is coupled to a gate 540 of the transistor 520 to switch it on. The bias voltage V_BIAS would therefore be equal to the regulated voltage VDD_REG less a potential drop across the transistor 520. The transistor 520 may be an n-channel transistor according to various embodiments.

Figure 6:
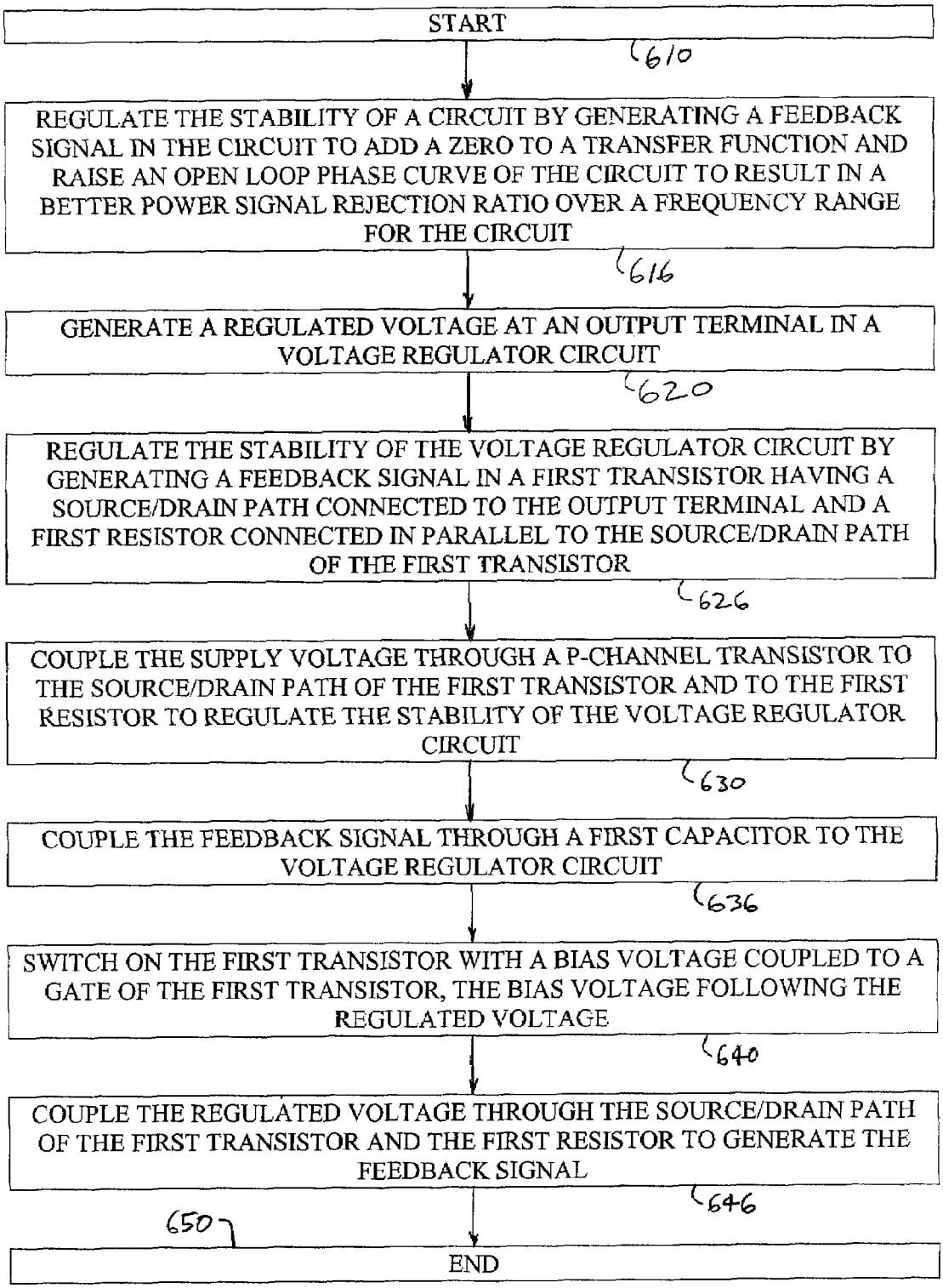
FIG. 6 illustrates a flow diagram of several methods according to various embodiments.

FIG. 6 illustrates a flow diagram of several methods according to various embodiments. In 610, the methods start.

In 616, the stability of a circuit is regulated by generating a feedback signal in the circuit to add a zero to a transfer function and raise an open loop phase curve of the circuit to result in a better power signal rejection ratio over a frequency range for the circuit.

In 620, a regulated voltage is generated at an output terminal in a voltage regulator circuit.

In 626, the stability of the voltage regulator circuit is regulated by generating a feedback signal in a first transistor having a source/drain path connected to the output terminal and a first resistor connected in parallel to the source/drain path of the first transistor.

In 630, the supply voltage is coupled through a p-channel transistor to the source/drain path of the first transistor and to the first resistor to regulate the stability of the voltage regulator circuit.

In 636, the feedback signal is coupled through a first capacitor to the voltage regulator circuit.

In 640, the first transistor is switched on with a bias voltage coupled to a gate of the first transistor, the bias voltage following the regulated voltage.

In 646, the regulated voltage is coupled through the source/drain path of the first transistor and the first resistor to generate the feedback signal. In 650, the methods end.

Figure 7:
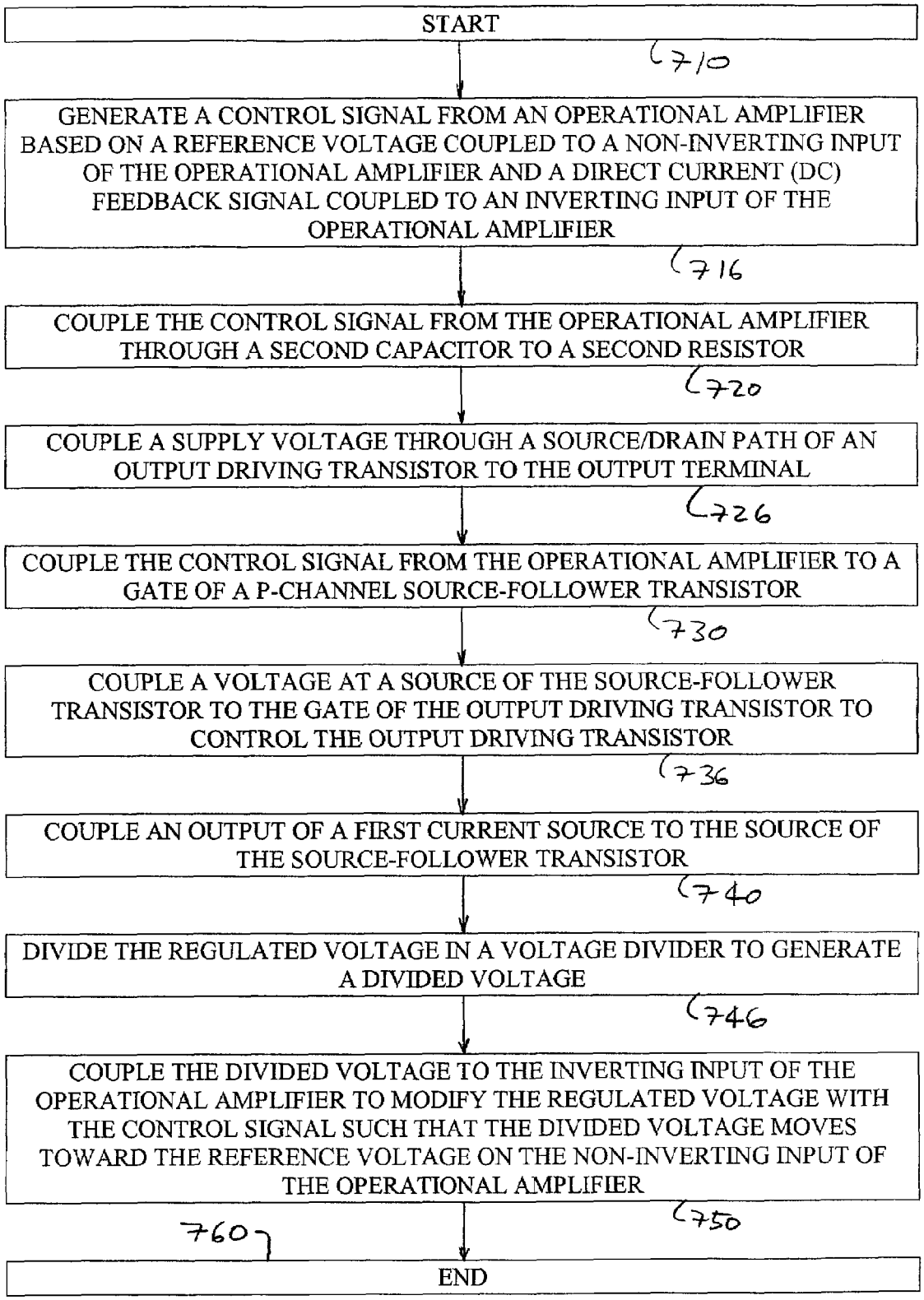
FIG. 7 illustrates a flow diagram of several methods according to various embodiments.

FIG. 7 illustrates a flow diagram of several methods according to various embodiments. In 710, the methods start.

In 716, a control signal is generated from an operational amplifier based on a reference voltage coupled to a non-inverting input of the operational amplifier and a direct current (DC) feedback signal coupled to an inverting input of the operational amplifier.

In 720, the control signal is coupled from the operational amplifier through a second capacitor to a second resistor.

In 726, a supply voltage is coupled through a source/drain path of an output driving transistor to the output terminal.

In 730, the control signal is coupled from the operational amplifier to a gate of a p-channel source-follower transistor.

In 736, a voltage at a source of the source-follower transistor is coupled to the gate of the output driving transistor to control the output driving transistor.

In 740, an output of a first current source is coupled to the source of the source-follower transistor.

In 746, the regulated voltage is divided in a voltage divider to generate a divided voltage.

In 750, the divided voltage is coupled to the inverting input of the operational amplifier to modify the regulated voltage with the control signal such that the divided voltage moves toward the reference voltage on the non-inverting input of the operational amplifier. In 760, the methods end.

It should be noted that the individual activities shown in the flow diagrams do not have to be performed in the order illustrated or in any particular order. Moreover, various activities described with respect to the methods identified herein can be executed in serial or parallel fashion. Some activities may be repeated indefinitely, and others may occur only once. Various embodiments may have more or fewer activities than those illustrated.

One or more of the p-channel transistors described herein may be p-channel metal oxide semiconductor (PMOS) transistors.

According to various embodiments, a voltage regulator circuit includes an operational amplifier, a source-follower transistor, and a p-channel current driving transistor to generate a regulated voltage at an output. The stability of the voltage regulator circuit is regulated with an AC feedback signal from a transistor in parallel with a resistor connected between the output and the operational amplifier, a capacitance included therebetween.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments of the invention. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims.

In addition, in the foregoing Detailed Description, it can be seen that various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment.

Thus the following claims are hereby incorporated into the Detailed Description, with each claim standing on its own as a separate preferred embodiment. In the appended claims, the terms "including" and "in which" are used as the plain-English equivalents of the respective terms "comprising" and "wherein," respectively. Moreover, the terms "first," "second," and "third," etc. are used merely as labels, and are not intended to impose numerical requirements on their objects.

The invention claimed is:

1. An apparatus comprising:

a voltage regulator circuit including an output terminal to generate a regulated voltage and at least one input terminal;

a first transistor with a gate coupled in parallel with a first resistor between the output terminal and the input terminal to couple a feedback signal to the input terminal while operating in a linear region to regulate the stability of the voltage regulator circuit, wherein the potential of the gate of the first transistor follows the regulated voltage of the output terminal;

the first transistor is switched on by a bias voltage coupled to a gate of the first transistor, the bias voltage to follow the regulated voltage;

the first transistor is a p-channel transistor, and the bias voltage is less than the regulated voltage; and the first transistor is directly and electrically connected in parallel with the first resistor between the output terminal and the input terminal; and further comprising a first capacitor coupled between the input terminal and the parallel connection of the first transistor and the first resistor to couple the feedback signal to the input terminal.

2. The apparatus of claim 1, further comprising a source-follower transistor having a gate coupled to the output of the operational amplifier to receive the control signal and being coupled to the output driving transistor to amplify the control signal on the gate of the output driving transistor.

3. The apparatus of claim 2 wherein the source-follower transistor is a p-channel transistor having a source coupled to the gate of the output driving transistor, and a drain.

4. The apparatus of claim 3, further comprising a first current source coupled to the source of the source-follower transistor.

5. A system comprising:

a device; and a voltage regulator circuit to couple a regulated voltage to the device, the voltage regulator circuit including:

an output terminal to generate the regulated voltage and at least one input terminal; and a first transistor directly and electrically connected in parallel with a first resistor between the output terminal and the input terminal to couple a feedback signal to the input terminal while operating in a linear region to regulate the stability of the voltage regulator circuit, wherein the potential of a gate of the first transistor follows the regulated voltage of the output terminal; and a first capacitor coupled between the input terminal and the parallel connection of the first transistor and the first resistor to couple the feedback signal to the input terminal.

* * * * *